United States Patent [19]

Toth

[11] Patent Number: 4,685,674

[45] Date of Patent: Aug. 11, 1987

[54] AIR-SWING BALL GAME

[76] Inventor: Alexander Toth, 1223 Del Rey; Apt. No. 5, Pasadena, Calif. 91107

[21] Appl. No.: 842,781

[22] Filed: Mar. 21, 1986

[51] Int. Cl.[4] ..... A63D 7/00

[52] U.S. Cl. ..... 273/40; 273/82 R

[58] Field of Search ..... 273/37, 38, 40, 331, 273/332, 333, 334, 335, 393, 413, 82 R, 82 A

[56] References Cited

U.S. PATENT DOCUMENTS

| | | | |
|---|---|---|---|
| 649,745 | 5/1900 | Niemeyer | 273/82 R |
| 2,035,975 | 3/1936 | Meyer | 273/37 X |
| 2,319,917 | 5/1943 | Bruneau | 273/40 |

FOREIGN PATENT DOCUMENTS

| | | | |
|---|---|---|---|
| 14414 | 10/1887 | United Kingdom | 273/37 |

*Primary Examiner*—Anton O. Oechsle

*Attorney, Agent, or Firm*—Thomas I. Rozsa

[57] ABSTRACT

An air-swing ball game in which a ball suspended on a string is used to strike and knock down a plurality of pins set up according to a particularized scoring scheme and mounted on a game table having leaves that fold inwardly and upwardly to create a table useful for other purposes. The point of suspension of the ball can be changed to increase the level of difficulty of the game.

3 Claims, 9 Drawing Figures

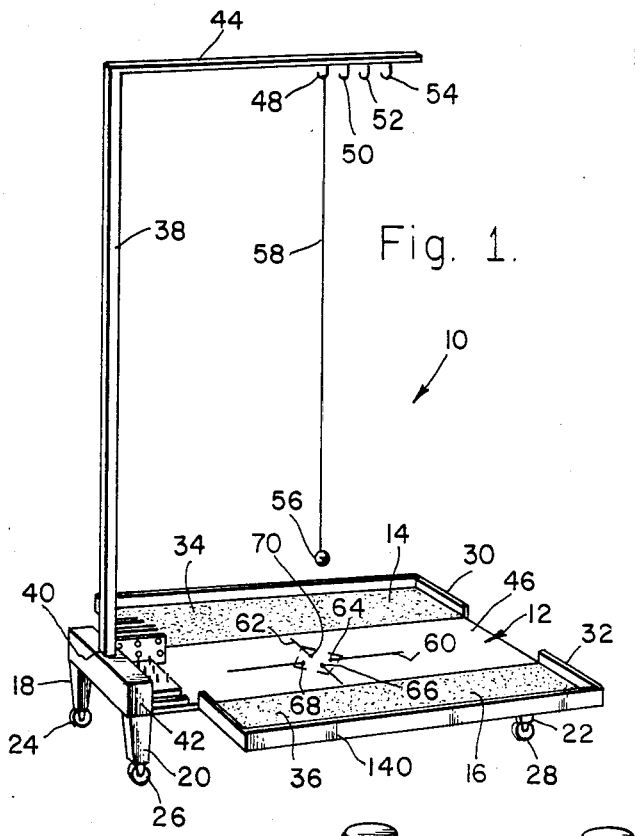
Fig. 1.
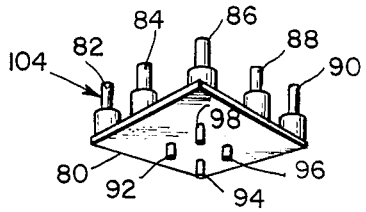
Fig. 2.
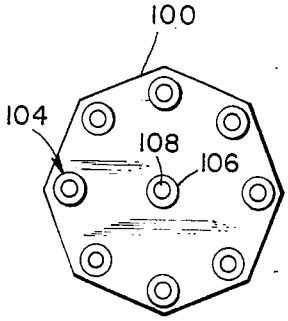
Fig. 3.
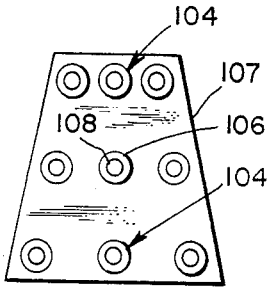
Fig. 4.
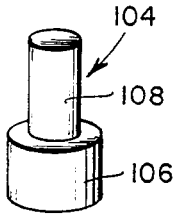
Fig. 5.
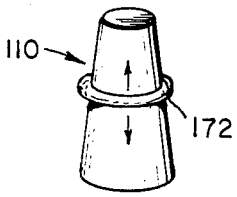
Fig. 6.
Fig. 7.
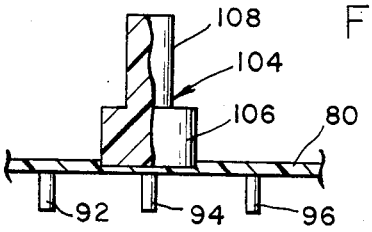
Fig. 8.
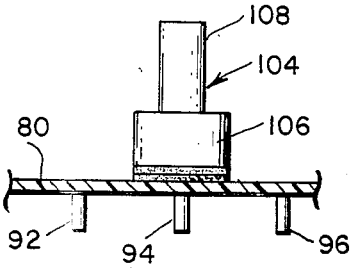
Fig. 9.
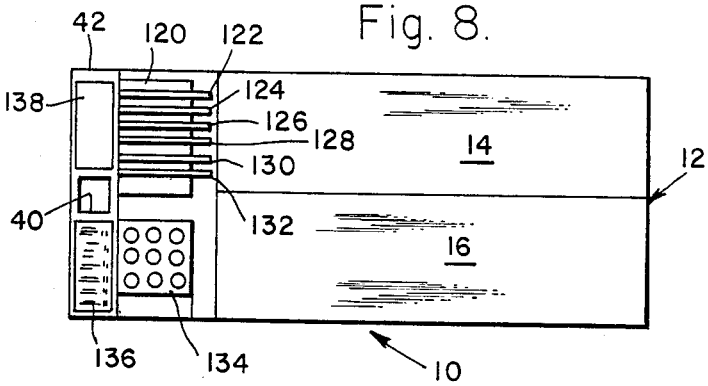

AIR-SWING BALL GAME

BACKGROUND OF THE INVENTION

1. FIELD OF THE INVENTION

The present invention relates to air-swing ball games. More particularly, the present invention relates to an air-swing ball game in which a ball suspended by string is swung by a player in an attempt to knock down a plurality of pins on a playing surface.

2. DESCRIPTION OF THE PRIOR ART

Games in which a player attempts to knock down a number of tokens or pins by swinging a ball attached to a string at one end and to an elevated arm at the other are well known in the prior art. One such game is disclosed in U.S. Pat. No. 979,598 to Thimm, which illustrates a number of pins, which stand on a pad, and a ball suspended from a spring or rope, which are attached to a horizontal arm. To play the game, a player pulls down on the ball, thereby energizing the spring and then swings the ball toward the pins in an effort to knock them over. The pins aligned with the natural arc of the swinging ball are relatively easy to knock over, due to their relationship with the natural swing of the ball by the player. Different games having different levels of difficulty can be divised by ordering the pins differently, or specifying which particular pins need to be knocked down in order to win.

Another device of this general type is disclosed in U.S. Pat. No. 1,371,831 to Workman, which employs a compactly foldable game apparatus involving the exercise of a certain degree of skill involving the principle of the operation of a universally mounted pendulum which is used to knock down pins, that stand on an elevated platform in the playing surface.

U.S. Pat. No. 712,923, to Frysinger, disclosed a pendulum-type ball swing game in which the object is to kncok over a plurality of pins with a ball attached to a string and a supporting arm, thereby forming a pendulum, with the pins freely resting upon the base, which has a plurality of marked spots, which may be painted, stained, or otherwise marked, for designating the proper spot to place a pin.

U.S. Pat. No. 3,726,524, to Prischak et al., disclosed a tethered ball bowling game in which the object is to knock down a plurality of pins, with a ball suspended from a string, which is attached to an elevated arm disposed somewhat above the horizontal. In Prischak, the string is not fixedly attached to the supporting arm, but is affixed to a ring which slides along the length of the arm during a stroke by the player, thereby changing the suspension point of the ball.

This prior art does not, however, suggest an air swing ball game having a plurality of differently shaped pin-holder plates wherein the holder plates include depending pegs for alignment with peg hols in a game table, for quick and accurate positioning of the pin holder-plate, combined with color-coded spots in pins to designate the proper position for each pin, wherein each color of pin has a corresponding weighted point value and the horizontal suspension arm includes a plurality of space hooks, any one of which the string holding the ball may be suspended from, thereby making the game more difficult or easier.

Therefore, a significant need exists for an air-swing ball game in which the level of difficulty can be changed by changing the position of the ball and string relative to the pins, different shapes of pin-holder plates are included to permit flexibility as to the difficulty of the game, and wherein the holder plates are quickly and accurately placed in their proper position by mating depending pegs on the bottom surface of the holder plate into corresponding holes in the game surface itself.

SUMMARY OF THE PRESENT INVENTION

The present invention relates to an air-swing ball game having a greater number of possible games and levels of difficulty than related games found in the prior art. Thus, the present invention can be played at a very simple, easy level for beginners and children, or at a very difficult level that requires highly skilled play, or at any level intermediate beginning and expert levels. It will be apparent from the description that follows that many minor variations and changes in the present invention may be made and therefore the following text is offered only by way of illustration and not by way of limitation.

Accordingly, it is an object of the present invention to provide an air-swing ball game in which the playing surface folds to provide a piece of furniture, such as an end table or a coffee table.

It is another object of the present invention to provide an air-swing ball game which employs a variety of shapes of pin-holder plates for designating a plurality of patterns for positioning pins, to change the nature of the game and the level of difficulty.

It is another object of the present invention to provide an air-swing ball game in which the position of the ball relative to the pins can be changed, thereby requiring different levels of skill to play the game.

It is another object of the present invention to provide an air-swing ball game in which the pins can be made more difficult to knock down, thereby to increase the level of skill required to play the game successfully.

Further novel features and other objects of the present invention will become apparent from the following detailed description, discussion and appended claims taken in conjunction with the drawings.

DRAWING SUMMARY

Referring particularly to the drawings for the purpose of illustration only and not limitation, there is illustrated:

FIG. 1 is a perspective view of an air-swing ball game according to the present invention.

FIG. 2 is a perspective view of a pin-holder plate according to the present invention.

FIG. 3 is a plan view of an alternative embodiment of a pin-holder plate.

FIG. 4 is a plan view of still another embodiment of the pin-holder plate according to the present invention.

FIG. 5 is a perspective view of one embodiment of a pin according to the present invention.

FIG. 6 is a perspective view of another embodiment of a pin according to the present invention.

FIG. 7 is a side elevation partially in section, illustrating the pin-holder plate and a pin in place thereon.

FIG. 8 is a plan view of a game table according to the present invention, showing the leaves in closed position.

FIG. 9 is a side elevation of the pin-holder plate of FIG. 2, with a pin resting on its upper surface.

DETAILED DESCRIPTION OF THE PREFERRED EMBODIMENT

Although the apparatus of the present invention will now be described with reference to the specific embodiments shown by the drawings, it should be understood that such embodiments are described by way of examples only and are merely illustrative of one of many possible specific embodiments that represent applications of the principles of the invention. Various changes and modifications, obvious to one skilled in the art to which the invention pertains, are deemed to be within the spirit, scope, and contemplation of the invention as further defined in the appended claims.

Referring to FIG. 1, air-swing ball game 10 comprises game table 12 including folding leaves 14, 16, which fold upwardly and inwardly to cover the central portion of game table 12, thereby providing a closed, finished surface on the game table as illustrated in FIG. 8. Air-swing ball game 10 also includes legs 18, 20, 22, and a fourth leg that is not visible in the figures. Leaves 14 and 16 include lips 30, 32 respectively about their outside edges, for retaining knocked over pins on the playing surface. The upward facing surface of leaves 14, 16 in the open position may include soft-textured surfaces, clothe surfaces 34, 36, for providing increased friction with the pins after they are knocked over, thereby improving the chances that the pins will be retained on the playing surface of game table 12. Each leg 18, 20, 22, and the fourth leg may be equipped with casters 24, 26, and 28, and a caster for the fourth leg.

Air-swing ball game 10 further includes post 38, generally vertically disposed, which is removably inserted into hole 40 in frame 42 of game table 12. Post 38 supports arm 44, which is substantially vertically oriented and projects outwardly substantially along the lengthwise center line of center portion 46 of game table 12. Arm 44 includes four hooks 48, 50, 52, 54, for suspending ball 56 by string 58. Center portion 46 of game table 12 includes perpendicular lines 60, 62, for designating the proper center of a pin-holder plate and four peg-holes 64, 66, 68, 70, for receiving mating pegs projecting from the bottom of each pin-holder plate, such as illustrated in FIG. 2.

FIG. 2 illustrates square pin-holder plate 80, having nine pins resting thereon, of which pins 82, 84, 86, 88, 90, are visible. These pins merely rest on the upper surface of the pin-holder plates illustrated in the figures, although in an alternative embodiment (not shown) these pins are seated within recesses in the pin-holder plate, thereby making it more difficult to knock them down with ball 56. Pin-holder plate 80 further includes four depending pegs 92, 94, 96, 98, which mate with the corresponding peg-holes in center portion 46 of game table 12, for retaining the pin-holder plate in its proper position and for quickly locating and placing it in that proper position.

FIGS. 3 and 4 disclose alternative embodiments of a pin-holder plate. FIG. 3 discloses an octagonal pin-holder plate 100 having nine pins, eight of which are uniformly spaced along the perimeter of octagonal pin-holder plate 100, and one of which is placed in the center of plate 100. FIG. 4 discloses a regular trapezoidal pin-holder plate 102, having nine pins disposed as shown. Naturally, pin-holder plates may be made in any two-dimensional geometric shape, regular or irregular, and any desired number of pins may be placed thereon, limited only by the space available and the level of difficulty a player finds challenging.

In the preferred embodiment described herein, each pin is a different color and it is to be placed on a matching colored spot or mark on the pin-holder plate. In play, some pins, due to their location, are much easier to knock down than other pins. The different levels of difficulty involved in knocking down the pins in different positions on the plate is taken into account by assigning different point values to the different colored pins, according to the empirical results of the level of difficulty of their play.

FIG. 5 discloses pin 104 having cylindrical base 106 and cylindrical top portion 108 of smaller diameter than cylindrical base 106. FIG. 6 discloses an alternative embodiment of the pin, namely truncated conical pin 110 having slideably adjustable weight 112 disposed circumferentially around the outer surface or truncated conical pin 112. Slideable adjustable weight 112 is constructed of stretchable and elastic material that is weighted. FIGS. 7 and 9 illustrate pin 104 in position on pin-holder plate 80.

When leaves 14, 16 are closed upwardly and inwardly, they form the flat surfaced furniture piece shown in FIG. 8. One end of game table 12, the left end as illustrated in FIG. 8, includes rack 120, for holding a plurality of different shaped pin-holder plates 124, 126, 128, 130, 132, in a vertical position for storage when the game is not in use. Plate 134 includes recesses for retaining nine pins in a vertical position for storage when the game is not in use. Scoring block 136 includes color codes and point values for the various pins. Block 138 designates the assignment number of each pin-holder plate in its respective place and may be used to hold a score pad.

Most of air-swing ball game 10 can be advantageously made of wood, especially game table 12, including leaves 14, 16, frame 42, arm 44, and post 38. Ball 56 may be advantageously made of rubber or may be of a denser material, even steel. Pin-holder plates, such as plate 80, may be made of metal, plastic, wood, or any other suitable material. Pin 104 and truncated conical pin 110 may be advantageously made of metal, plastic, wood, or any other suitable material and may be weighted in the base with steel, lead, or other suitable weighting material to lower the center of gravity and make the pins more stable. String 58 may be any suitable type string, such as cotton, nylon, or fine steel cable.

In play, different rules may be developed by different players in different situations, but the basic object is to knock over one or more or all pins on a pin-holder plate by swinging the ball on the string at them. To swing the ball directly at the pins and knock them down is relatively easy, even for beginners, and the level of difficulty may be increased by requiring that the player, for example, strike pins only as the ball is returning to the player after having swung behind the pins, as viewed by the player.

Another method of increasing the level of difficulty is to provide pins having a greater amount of weight in the bottom, or by sliding adjustable weight 112 farther down truncated conical pin 110, thereby lowering its center of gravity and making it more difficult to knock over.

Another way of making the game more difficult is to require that the player address the ball and pins from the edge 140 of leaf 16 and then to move the string progressively from hook 48 to hook 50, to hook 52, and finally, to hook 54. As is apparent from viewing FIG. 1, as ball 56 and string 58 is moved progressively from one hook to the next, the ball is suspended further and further from the center line of pin-holder plate 80, requiring the player to swing the ball further out of its natural pendulum swing in order to strike the pins.

Although the preferred embodiments of the invention have been illustrated and described, it is apparent that these can be modified by those skilled in the art and that the scope of the invention is not limited to the precise details set forth. Naturally, the present invention is not intended to be restricted to any particular form or arrangement, or to any specific embodiment disclosed herein, or any specific use, since the present invention may be modified in various particulars of relations without departing from the spirit or scope of the claimed invention shown and described herein, of which the apparatus shown is intended only for illustration and for disclosure of an operative embodiment and not to show all of the various forms or modifications which might embody the invention.

The invention has been described in considerable detail in order to comply with the patent laws by providing a full public disclosure of one of its forms. Such detailed description is not, however, intended to limit the broad features or principles of the invention, or the scope of the patent property to be granted.

What is claimed is:

1. A game comprising:

a. a game table having a flat upper surface formed by upwardly and outwardly opening two leaves, each attached to one side of a center portion of said game table thereby forming a flat upper surface for playing the game, said game table having a front end and a back end, and four peg-holes in said playing surface;

b. a pin-holder plate including four depending pegs for being detachably received by said four peg-hole, thereby providing a pin-holding surface on said playing surface, said pin-holding surface holding nine different color marks distributed in a regular pattern;

c. nine pins of different colors, the color of each said pin matching the color of one said mark on said pin-holding plate, said pins being set upright on said pin-holding surface;

d. a ball-swing support including a substantially vertical post detachably mounted at the back end of said game table, a horizontal arm detachably mounted on said post and extending forward toward the front of said game table;

e. four hooks attached to said arms at spaced intervals toward the front of said game table;

f. a string attached at one end to one of said hooks; and g. a ball attached to the other end of said string.

2. A game comprising:

a. a game table having a flat upper surface for playing the game; and having a front end and a back end; and four peg holes in said game table;

b. a pin-holder plate including four depending pegs each of which is removably inserted within a respective one of said four peg holes to thereby provide a pin-holding surface on said playing surface;

c. nine separate pins each set upright on said pin-holder plate;

d. said pin holding surface of said pin-holder plate including nine regularly spaced different marks of nine different colors for marking the proper position of the nine different pins and each of said nine different pins having a different color which matches one of said colored marks;

e. a ball-swing support including a substantially vertical post detachably mounted at the back end of said game table, a horizontal arm detachably mounted on said post and extending forward toward the front of said game table;

f. at least one hook attached to said arm;

g. a string attached at one end to said hook; and h. a ball attached to the other end of said string.

3. A game comprising:

a. a game table having a flat upper surface for playing the game; and having a front end and a back end; and at least one peg-hole in said game table;

b. a pin-holder plate including at least one depending peg detachably inserted within said peg-hole to thereby provide a pin-holding surface on said playing surface;

c. at least one pin set upright on said pinholder plate;

d. a ball-swing support including a substantially vertical post detachably mounted at the back end of said game table, a horizontal arm detachably mounted on said post and extending forward toward the front of said game table;

e. four spaced hooks attached to said horizontal arm;

f. a string which may be attached at one end to any one of said four spaced hooks for making the game easier or harder; and g. a ball attached to the other end of said string.

* * * * *